US010808204B2

(12) United States Patent
Flugge-Berendes et al.

(10) Patent No.: US 10,808,204 B2
(45) Date of Patent: Oct. 20, 2020

(54) AQUEOUS CLEANING COMPOSITION WITH TERTIARY AMINE IONIC LIQUID AND QUATERNARY AMMONIUM ANTIMICROBIAL SURFACTANT

(71) Applicant: S.C. Johnson & Son, Inc., Racine, WI (US)

(72) Inventors: Lisa Ann Flugge-Berendes, Kenosha, WI (US); Art Daniels Sutton, Jr., Mabane, NC (US); Michael Scott Haas, Franklin, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 16/342,360

(22) PCT Filed: Oct. 17, 2017

(86) PCT No.: PCT/US2017/056942

§ 371 (c)(1),
(2) Date: Apr. 16, 2019

(87) PCT Pub. No.: WO2018/080839

PCT Pub. Date: May 3, 2018

(65) Prior Publication Data

US 2019/0241839 A1 Aug. 8, 2019

Related U.S. Application Data

(60) Provisional application No. 62/413,224, filed on Oct. 26, 2016.

(51) Int. Cl.

| | |
|---|---|
| ***C11D 1/83*** | (2006.01) |
| ***C11D 1/86*** | (2006.01) |
| ***C11D 3/33*** | (2006.01) |
| ***C11D 11/00*** | (2006.01) |
| ***C11D 1/835*** | (2006.01) |
| ***C11D 1/65*** | (2006.01) |
| *C11D 1/14* | (2006.01) |
| *C11D 1/62* | (2006.01) |
| *C11D 1/72* | (2006.01) |
| *C11D 1/75* | (2006.01) |

(52) U.S. Cl.

CPC ..... *C11D 1/86* (2013.01); *C11D 1/65* (2013.01); *C11D 1/835* (2013.01); *C11D 3/33* (2013.01); *C11D 11/0023* (2013.01); *C11D 1/143* (2013.01); *C11D 1/146* (2013.01); *C11D 1/62* (2013.01); *C11D 1/72* (2013.01); *C11D 1/75* (2013.01)

(58) Field of Classification Search

CPC .... C11D 1/12; C11D 1/62; C11D 1/65; C11D 1/75; C11D 1/722; C11D 1/83; C11D 1/835; C11D 1/94; C11D 3/33

See application file for complete search history.

(56) References Cited

U.S. PATENT DOCUMENTS

| | | | | |
|---|---|---|---|---|
| 4,284,435 | A | 8/1981 | Fox | |
| 4,518,585 | A | 5/1985 | Greene et al. | |
| 4,551,506 | A | 11/1985 | Gosselink | |
| 5,414,124 | A | 5/1995 | Smith et al. | |
| 5,441,541 | A | 8/1995 | Mehreteab et al. | |
| 5,472,455 | A | 12/1995 | Mehreteab et al. | |
| 5,552,089 | A | 9/1996 | Misselyn et al. | |
| 5,554,320 | A | 9/1996 | Yianakopoulos | |
| 5,798,329 | A | 8/1998 | Taylor et al. | |
| 5,827,451 | A | 10/1998 | Cummings et al. | |
| 5,939,059 | A | 8/1999 | Franklin et al. | |
| 5,962,388 | A | 10/1999 | Sherry et al. | |
| 5,994,602 | A | 11/1999 | Abdul-Sada et al. | |
| 6,087,303 | A * | 7/2000 | Walker | A01N 33/12 106/15.05 |
| 6,462,014 | B1 | 10/2002 | Johnson et al. | |
| 6,465,403 | B1 | 10/2002 | Skee | |
| 6,509,012 | B1 | 1/2003 | Hossel et al. | |
| 6,544,350 | B2 | 4/2003 | Muller et al. | |
| 6,573,405 | B1 | 6/2003 | Abbott et al. | |
| 6,605,584 | B2 | 8/2003 | Fong et al. | |
| 6,693,070 | B1 | 2/2004 | Cheung et al. | |
| 6,878,681 | B1 | 4/2005 | Gohl et al. | |
| 6,953,773 | B2 | 10/2005 | Pereira et al. | |
| 7,183,433 | B2 | 2/2007 | Abbott et al. | |
| 7,186,675 | B2 | 3/2007 | Meine et al. | |
| 7,189,685 | B2 | 3/2007 | Hubig et al. | |
| 7,196,221 | B2 | 3/2007 | Abbott et al. | |
| 7,235,494 | B2 | 6/2007 | Andreas | |
| 7,348,303 | B2 | 3/2008 | Gallotti et al. | |

(Continued)

FOREIGN PATENT DOCUMENTS

| | | |
|---|---|---|
| EP | 0 111 965 A2 | 6/1984 |
| GB | 2067196 B | 12/1983 |
| WO | WO 2018/080835 | 5/2018 |
| WO | WO 2018/080836 | 5/2018 |

OTHER PUBLICATIONS

U.S. Appl. No. 16/341,743, filed Apr. 17, 2019, Davis et al.
U.S. Appl. No. 16/342,737, filed Apr. 17, 2019, Sutton, Jr. et al.
CN103849490A Abstract, Jun. 11, 2014, 1 page.
CN104293489A Abstract, Jan. 21, 2015, 1 page.
Written Opinion for PCT Application No. PCT/2017/056942, dated Jan. 3, 2018, 8 pages.

*Primary Examiner* — Charles I Boyer

(57) ABSTRACT

An aqueous cleaning composition, which may be suitable for use in cleaning hard surfaces, is described. The aqueous cleaning composition includes an N,N-dialkyl-N-aliphatic ammonium hydroxycarboxylate salt, a nonionic surfactant and/or anionic surfactant and a substantial amount of water. Other than an optional fragrance component, the cleaning composition is substantially free of volatile organic compounds. The cleaning compositions may also include a disinfecting quaternary surfactant and/or a chelating agent, such as an aminopolycarboxylate chelating agent.

21 Claims, No Drawings

(56) References Cited

U.S. PATENT DOCUMENTS

| | | | |
|---|---|---|---|
| 7,544,807 | B2 | 6/2009 | Wasserscheid et al. |
| 7,588,645 | B2 | 9/2009 | Griese et al. |
| 7,737,106 | B2 | 6/2010 | Kenneally et al. |
| 7,776,810 | B2 | 8/2010 | Jordan, IV et al. |
| 7,786,064 | B1 | 8/2010 | Hecht et al. |
| 7,786,065 | B2 | 8/2010 | Hecht et al. |
| 7,863,458 | B2 | 1/2011 | Wasserscheid et al. |
| 7,880,024 | B2 | 2/2011 | Lim et al. |
| 7,923,424 | B2 | 4/2011 | Small |
| 7,928,053 | B2 | 4/2011 | Hecht et al. |
| 8,110,537 | B2 | 2/2012 | Gohl et al. |
| 8,308,824 | B2 | 11/2012 | Wood et al. |
| 8,481,474 | B1 | 7/2013 | Blattner et al. |
| 8,518,298 | B2 | 8/2013 | Abbott |
| 8,709,169 | B2 | 4/2014 | Company et al. |
| 8,716,207 | B2 | 5/2014 | Blattner et al. |
| 8,901,061 | B2 | 12/2014 | D'Ambrogio et al. |
| 9,090,855 | B2 | 7/2015 | Polzin et al. |
| 9,157,051 | B2 | 10/2015 | D'Ambrogio et al. |
| 9,359,499 | B2 | 6/2016 | Cernohous |
| 9,719,057 | B2 | 8/2017 | Nielsen et al. |
| 9,920,284 | B2 | 3/2018 | Sutton, Jr. et al. |
| 10,179,890 | B2 | 1/2019 | Sutton, Jr. et al. |
| 2003/0064910 | A1 | 4/2003 | Fong et al. |
| 2003/0089891 | A1 | 5/2003 | Andreas |
| 2003/0228991 | A1 | 12/2003 | Johnson et al. |
| 2004/0077519 | A1 | 4/2004 | Price et al. |
| 2004/0138084 | A1 | 7/2004 | Gohl et al. |
| 2004/0167057 | A1 | 8/2004 | Pereira et al. |
| 2004/0266658 | A1 | 12/2004 | Lenhart |
| 2005/0164903 | A1 | 7/2005 | Ko et al. |
| 2006/0019863 | A1 | 1/2006 | Hubig et al. |
| 2006/0084729 | A1 | 4/2006 | Clarke |
| 2006/0157089 | A1 | 7/2006 | Taylor et al. |
| 2006/0183654 | A1 | 8/2006 | Small |
| 2006/0234889 | A1 | 10/2006 | Griese et al. |
| 2006/0234890 | A1 | 10/2006 | Griese et al. |
| 2007/0010607 | A1 | 1/2007 | Smith et al. |
| 2008/0139443 | A1 | 6/2008 | Buzinski et al. |
| 2010/0099314 | A1 | 4/2010 | Hecht et al. |
| 2012/0258067 | A1 | 10/2012 | Yang et al. |
| 2013/0247308 | A1 | 9/2013 | Duerrschmidt et al. |
| 2013/0261044 | A1 | 10/2013 | Lambert et al. |
| 2014/0065088 | A1 | 3/2014 | Frantz et al. |
| 2014/0083465 | A1 | 3/2014 | D'Ambrogio et al. |
| 2014/0090671 | A1 | 4/2014 | D'Ambrogio et al. |
| 2014/0121291 | A1 | 5/2014 | Cernohous |
| 2016/0017262 | A1 | 1/2016 | Monster et al. |
| 2016/0151527 | A1 | 6/2016 | Holland et al. |
| 2017/0347644 | A1 | 12/2017 | Silvernail et al. |
| 2018/0343859 | A1 | 12/2018 | Jiang et al. |

* cited by examiner

AQUEOUS CLEANING COMPOSITION WITH TERTIARY AMINE IONIC LIQUID AND QUATERNARY AMMONIUM ANTIMICROBIAL SURFACTANT

CROSS-REFERENCE TO RELATED APPLICATIONS

This patent application is a U.S. national stage of International Application Ser. No. PCT/US2017/056942, filed on Oct. 17, 2017, which claims the benefit of U.S. Provisional Application Ser. No. 62/413,224, filed on Oct. 26, 2016; the entire contents of which are hereby incorporated by reference, for any and all purposes.

BACKGROUND

Many current cleaning products often include using a "smelly" cleaner and compensate for the unpleasant odor by the need for running a fan, opening a window, or leaving the room; using a bad smelling cleaner but then following up with an air freshener or other solution; or using a cleaner that is not as effective and put more effort into cleaning the mess. Current commercial cleaning products that perform well on the removal of soap scum or greasy soil often have an unpleasant odor. For instance, some cleaners are quite unpleasant to use and others may have a sour or bleach odor, which many consumers find objectionable.

SUMMARY

The present application relates generally to the field of cleaning compositions and, in particular, aqueous cleaning compositions which may be especially useful for cleaning hard surfaces. The present cleaning compositions include an ionic liquid and are generally, with the exception of a small amount of optional fragrance material, substantially free of solvent and other volatile organic compounds. In ready to use form, the present cleaning compositions are typically aqueous compositions which include a substantial amount of water, e.g., at least about 85 wt. % and often at least about 90 wt. % or even 95 wt. % or higher. The ionic liquid component may suitably include one or more N,N-dialkyl-N-aliphatic ammonium salts, such as an N,N-dialkyl-N-aliphatic ammonium hydroxycarboxylate salt. The N,N-dialkyl-N-aliphatic ammonium hydroxycarboxylate salt(s) may include an N,N-di-alkyl-N—($C_{8-14}$)-aliphatic ammonium hydroxycarboxylate salt. For example, the ionic liquid may include an N,N-di-($C_{1-3}$)alkyl-N-fatty ammonium hydroxycarboxylate salt, e.g., an N,N-dimethyl-N—($C_{8-14}$)-n-alkyl ammonium hydroxycarboxylate salt. The cleaning compositions typically also include a nonionic surfactant and/or an anionic surfactant. For example, the cleaning composition may also include a nonionic surfactant, such as an ethoxylated alcohol and/or alkyl amine oxide, and/or an anionic surfactant, such as an alkylsulfate and/or alkylsulfonate salt. In some instances, the cleaning compositions may include a quaternary ammonium antimicrobial surfactant, such as a quaternary benzyl ammonium salt and/or a quaternary bis(alkyl)dimethylammonium salt. Optionally, the cleaning compositions may also include one or more adjuvants, such as a fragrance, a preservative, a complexing agent and/or a bleaching agent. Where such a cleaning composition is intended to be used as an aerosol cleaner, it may be formulated in a pressurized container together with a propellant, such as a hydrocarbon propellant, a hydrofluoroalkane propellant and/or a volatile ether propellant. The present cleaning compositions typically have a relatively neutral pH to somewhat acidic pH, e.g., a pH of about 4 to 7 and, quite commonly about 4 to 6.

In some embodiments, the cleaning composition may include (a) N,N-dialkyl-N-aliphatic ammonium hydroxycarboxylate salt; (b) nonionic surfactant and/or anionic surfactant; and (c) at least about 85 wt. % water. The nonionic surfactant component may include ethoxylated alkanol and/or alkyldimethylamine oxide. The anionic surfactant component may include an alkylsulfate and/or alkylsulfonate salt. Such cleaning compositions may have a pH of about 4 to 7. These cleaning compositions desirably are substantially free (e.g., contain no more than 0.1 wt) of glycol ether solvents, aliphatic alcohol solvents, polyol solvents and amino alcohol solvents. In many instances, other than an optional fragrance component, the composition is substantially free of volatile organic compounds, e.g., contains no more than 0.1 wt. % VOC.

In one particular embodiment, the cleaning composition may include (a) N,N-dialkyl-N-fatty ammonium hydroxycarboxylate salt; (b) nonionic surfactant; and (c) at least about 85 wt. % water; wherein the composition has a pH of about 4 to 7. Such compositions are desirably substantially free of glycol ether solvents, aliphatic alcohol solvents, polyol solvents and amino alcohol solvents. For example, such compositions may desirably include no more than a total of 0.1 wt. % of alcohol solvents, such as aliphatic alcohols, amino alcohols (e.g., ethanol amines), glycol ether solvents, such as diethylene glycol monobutyl ether, dipropylene glycol butyl ether, dipropylene glycol propyl ether, and monoalkyl glycols, and polyol solvents, such as alkylene glycols and glycerol.

In another particular embodiment, the cleaning composition may have a pH of about 4 to 7 and comprise (a) about 0.1 to 4 wt. % N,N-dimethyl-N-n-decylammonium citrate; (b) about 0.5 to 3 wt. % ($C_{8-12}$)-alkyl sulfate salt; (c) about 0.2 to 5 wt. % ethoxylated $C_{10-15}$-alkanol having an average degree of ethoxylation of about 6 to 10; (d) optionally, about 0.1 to 5 wt. % iminodisuccinate salt and/or glutamate diacetic acid salt; and (e) at least about 90 wt. % water; where, other than an optional fragrance component, the composition is substantially free of volatile organic compounds. Such compositions may optionally include an antimicrobial quaternary ammonium surfactant, such as N-(n-$C_{12-16}$)-alkyl-N-benzyl dimethylammonium chloride, N-(n-$C_{12-16}$)-alkyl-N-ethylbenzyl dimethylammonium chloride and/or bis(n-$C_{8-12}$-alkyl)dimethylammonium chloride.

While the aqueous cleaning composition commonly includes an N,N-dialkyl-N-aliphatic ammonium hydroxycarboxylate salt, in some embodiments other salts of such ammonium compounds may be used. For example, the cleaning composition may include an N,N-dialkyl-N-aliphatic ammonium mineral salt in which the counter anion is a halide anion (e.g., Br—, I—), Other suitable N,N-dialkyl-N-aliphatic ammonium salts can include other carboxylate anions, e.g., alkyl carboxylates, such as acetate salts and/or salts of $C_2$-$C_{10}$ alkanoic acids, alkylsulfate ($RSO_4^-$) salts, alkylsulfonate ($RSO_3^-$) salts, alkylphosphonate (e.g., $RPO_3^-$) salts and alkylphosphate (e.g., $R_2PO_4^-$) salts. Specific examples include acetate salts, chloride salts, and/or salts which include a methosulfate and/or ethosulfate anion.

DETAILED DESCRIPTION

The present cleaning compositions include an ionic liquid and, other than an optional fragrance component, are generally substantially free of organic solvents and other volatile organic compounds. For example, the cleaning composition may be substantially free of glycol ether solvents, aliphatic alcohol solvents, polyol solvents and amino alcohol solvents. The present cleaning compositions are commonly environmentally friendly due to being based on a low volatile organic content (VOC) formulation. Even though having significantly lower amounts of solvents as compared to conventional hard surface cleaning compositions, no loss of performance as to cleaning is generally observed (rather improved cleaning is typically obtained). As referred to herein, a composition having a low VOC or composition substantially free of volatile organic compounds is considered to be one which, other than an optional fragrance component, the composition contains no more than 0.1 wt. % volatile organic compounds. In some embodiments, a present cleaning compositions may have an even lower VOC concentration, such as ≤0.05 wt. % or ≤0.01 wt. % VOC.

In some embodiments, the present cleaning compositions include one or more N,N-di-($C_1$-$C_3$)alkyl-N—($C_8$-$C_{14}$)aliphatic ammonium hydroxycarboxylate salts, such as an N,N-dimethyl-N—($C_8$-$C_{14}$)alkylammonium citrate and/or an N,N-dimethyl-N—($C_8$-$C_{14}$)alkylammonium lactate. N,N-dimethyl-N-alkylammonium salts are also referred to herein as N-alkyl dimonium salts. In many instances, the N,N-di-($C_1$-$C_3$)alkyl-N—($C_8$-$C_{14}$)aliphatic ammonium hydroxycarboxylate salt(s) comprises N,N-dimethyl-N—($C_8$-$C_{14}$)-n-alkylammonium citrate and/or lactate, such as N,N-dimethyl-N-n-octylammonium citrate (also referred to as N-capryl dimonium citrate), N,N-dimethyl-N-n-decylammonium citrate (also referred to as N-caprylyl dimonium citrate), N,N-dimethyl-N-n-dodecylammonium citrate (also referred to as N-lauryl dimonium citrate).

Additional examples of suitable N,N-dialkyl-N-aliphatic ammonium hydroxycarboxylate salts include N,N-dimethyl-N-coco alkylammonium hydroxycarboxylate salts. The N-coco alkyl dimonium hydroxycarboxylate salts may suitably include N-coco alkyl dimonium citrate and N-coco alkyl dimonium lactate. Specific suitable examples include N-lauryl dimonium citrate, N-palmityl dimonium citrate, N-myristyl dimonium citrate, N-lauryl dimonium lactate, N-palmityl dimonium lactate, and/or myristyl dimonium lactate.

In the present compositions, the N,N-dialkyl-N-aliphatic ammonium hydroxycarboxylate salts may suitably be an ionic liquid formed from the reaction of one or more equivalents of an N,N-dialkyl-N-aliphatic amine with a hydroxycarboxylic acid, such as citric acid, tartaric acid, lactic acid, glucaric acid, gluconic acid and/or malic acid. For example, such ammonium hydroxycarboxylate salts formed from citric acid may include 1, 2 or 3 equivalents of amino cation, but typically are formed from the reaction of a roughly 1.5-2:1 mole ratio of the tertiary amine and citric acid.

In the present compositions, the N,N-dialkyl-N-aliphatic ammonium hydroxycarboxylate salt commonly includes an N,N-di-($C_1$-$C_3$)alkyl-N—($C_8$-$C_{14}$)-n-alkylammonium hydroxycarboxylate, such as an N,N-dialkyl-N—$C_{8-14}$-fatty alkylammonium hydroxycarboxylate salt. For example, in some embodiments the cleaning composition includes N-octyl dimonium citrate, N-decyl dimonium citrate, N-lauryl dimonium citrate, and/or N-myristyl dimonium citrate. In other embodiments, the cleaning composition may include N-octyl dimonium N-octyl dimonium lactate, N-decyl dimonium lactate, N-lauryl dimonium citrate and/or N-myristyl dimonium citrate. Typically, the present aqueous cleaning composition includes about 0.5 to 5 wt. % and, more commonly, about 1 to 4 wt. % of the N,N-dialkyl-N-aliphatic ammonium hydroxycarboxylate salt, such as an N,N-dimethyl-N—$C_{8-12}$-n-alkylammonium citrate.

The nonionic surfactant may be an alkoxylated alcohol, such as an ethoxylated ($C_{10}$-$C_{15}$) linear or branched aliphatic alcohol. The ethoxylated alcohol may have an average of about 5-15, typically 5 to 10 ethylene oxide groups. Examples of suitable alkoxylated alcohol nonionic surfactants include ethoxylated $C_{8-16}$-aliphatic alcohol having an average degree of ethoxylation of about 5 to 12. The ethoxylated $C_{8-16}$-aliphatic alcohol may include ethoxylated $C_{8-16}$-Guerbet alcohol, other secondary ethoxylated $C_{8-16}$-aliphatic alcohol and/or ethoxylated $C_{8-16}$-n-alkanol. Quite commonly the ethoxylated alcohol non-ionic surfactant includes an ethoxylated having an average degree of ethoxylation of about 5 to 10. When the cleaning compositions include an alkoxylated alcohol nonionic surfactant, the composition typically includes about 0.1 to 5 wt. % and, more commonly, about 0.5 to 3 wt. % of the alkoxylated alcohol. For example, the cleaning compositions may include about 0.5 to 4 wt. % of an ethoxylated alcohol, such as an ethoxylated $C_{10-15}$-alkanol, which may suitably have an average degree of ethoxylation of about 5 to 10.

Nonlimiting examples include ethoxylated long chain $C_{10}$-Guerbet alcohols, such as those produced by BASF and sold under the trade names LUTENSOL® XL100, LUTENSOL® XL80, LUTENSOL® XL70, LUTENSOL® XL60 and LUTENSOL® XP80 and. Particularly suitable nonionic surfactants include ethoxylated $C_{10}$-Guerbet alcohols having an HLB of from about 10 to about 15, commonly from about 12 to about 15. Examples include LUTENSOL XL80—an ethoxylated $C_{10}$-Guerbet alcohol with an average of 8 ethylene oxide (EO) groups, LUTENSOL® XL100—an ethoxylated $C_{10}$-Guerbet alcohol with an average of 10 EO groups, and an ethoxylated $C_{10}$-Guerbet alcohol having an HLB of about 13, such as the surfactant produced by BASF Corp. and sold under the trade name LUTENSOL® XL70.

Other examples of suitable nonionic surfactants include ethoxylated linear alcohols, such as ethoxylated linear alcohols having a $C_{10}$-$C_{15}$ n-alkyl group. Nonlimiting examples include LUTENSOL® TDA 10 (produced by BASF)—an ethoxylated tridecyl alcohol having an average of 10 EO groups, Genapol® LA 070S—an ethoxylated lauryl alcohol having an average of 7 EO groups, Tomadol® 91-6—a $C_9$-$C_{11}$ ethoxylated alcohol having an average of 6 EO groups, and LUTENSOL® AO-8—a synthetic $C_{13}$-$C_{15}$ ethoxylated oxo alcohol having an average of 8 EO groups.

Particularly suitable nonionic surfactants for use in the present cleaning compositions include ethoxylated fatty alcohols, e.g., ethoxylated $C_{12}$/$C_{14}$ fatty alcohols having a degree of ethoxylation of about 5 to 12 (5-12 EO) and more suitably a degree of ethoxylation of about 6 to 10; ethoxylated oxo alcohols, e.g., ethoxylated $C_{11}$-$C_{13}$ oxo alcohols having a degree of ethoxylation of about 5 to 15 and more suitably a degree of ethoxylation of about 5 to 10; ethoxylated Guebert alcohols, e.g., ethoxylated $C_{10}$ Guebert alcohols having a degree of ethoxylation of about 5 to 15 and more suitably a degree of ethoxylation of about 5 to 12; and ethoxylated secondary alcohols, e.g., ethoxylated secondary alcohols having a degree of ethoxylation of about 5 to 15 and more suitably a degree of ethoxylation of about 5 to 10.

Additional suitable nonionic surfactants include alkyl amine oxides, such as linear alkyl amine oxides. Typical alkyl amine oxides include water-soluble amine oxides of the formula $R^1$—N($R^2$)($R^3$)O where $R^1$ is typically a $C_8$-$C_{18}$ alkyl moiety and the $R^2$ and $R^3$ moieties are typically selected from the group consisting of hydrogen, $C_1$-$C_3$ alkyl groups and $C_1$-$C_3$ hydroxyalkyl groups. Quite often, the alkyl amine oxide is a linear alkyl amine oxide where $R^1$ is a $C_8$-$C_{18}$ n-alkyl and $R^2$ and $R^3$ are methyl, ethyl, propyl, isopropyl, 2-hydroxethyl, 2-hydroxypropyl and/or 3-hydroxypropyl. The linear amine oxide surfactants in particular may include linear $C_8$-$C_{14}$ alkyl dimethyl amine oxides and linear $C_8$-$C_{12}$-alkoxyethyl di(hydroxyethyl) amine oxides. Particularly suitable amine oxides include linear $C_{10}$, linear $C_{10}$-$C_{12}$, and linear $C_{12}$-$C_{14}$ alkyl dimethyl amine oxides. Other examples of amine oxide nonionic surfactants include alkyl amidopropyl amine oxides, such as lauryl/myristyl amidopropyl amine oxides (e.g., lauryl/myristyl amidopropyl dimethylamine oxide). When the cleaning compositions include an amine oxide nonionic surfactant, the composition typically includes about 0.1 to 5 wt. % and, more commonly, about 0.5 to 3 wt. % of the amine oxide.

Further nonionic surfactants which may be optionally present in the aqueous cleaning compositions are alkyl polyglycosides. Suitable alkyl polyglycosides include known nonionic surfactants which are alkaline and electrolyte stable. Alkyl mono and polyglycosides are generally prepared by reacting a monosaccharide, or a compound hydrolysable to a monosaccharide with an alcohol such as a fatty alcohol in an acid medium. The fatty alcohol may have from about 8 to 30 and typically 8 to 18 carbon atoms. Examples of such alkylglycosides include, APG 325 CS GLYCOSIDE which is reported to be a 50% $C_9$-$C_{11}$ alkyl polyglycoside (commercially available from Henkel Corp, Ambler Pa.) and GLUCOPON® 625 CS which is reported to be a 50% C10-C16 alkyl polyglycoside.

The cleaning composition may contain an anionic surfactant component. Anionic surfactants are often desirably included in cleaning compositions because of their wetting and detersive properties. Suitable examples of anionic surfactants include anionic sulfonate and/or sulfate surfactants. For example, the anionic surfactant component may include alkyl sulfate, alkyl ether sulfate, alkyl sulfonate and/or alkyl ether sulfonate surfactants. Suitable alkyl sulfates include those typically having an $C_8$-$C_{18}$ alkyl group. In some instances the alkyl sulfates suitably contain a secondary alkyl group. Examples of suitable alkyl sulfates include, but are not limited to, sodium octyl sulfate, sodium decyl sulfate, sodium lauryl sulfate, sodium lauryl/myristyl sulfate and mixtures thereof. Suitable alkane sulfonates that can be used in the cleaning composition may desirably have an alkane group having 8 to 22 carbon atoms. The alkyl sulfonates may include a secondary alkane sulfonate and/or alpha olefin sulfonate. The secondary alkane sulfonate may suitably include sodium $C_{14}$-$C_{17}$ secondary alkyl sulfonate (commercially available as Hostapur SAS from Clariant). Suitable alpha olefin sulfonates include those having alpha olefin groups containing 10 to 18 carbon atoms. Suitable alkyl ether sulfates may have about 1 to 10 repeating alkoxy groups, e.g., about 1 to 5 repeating ethoxy groups. In general, the alkoxy group will contain between about 2 and about 4 carbon atoms and, commonly is an ethoxy group. One example of a suitable alkyl ether sulfate is sodium lauryl ether sulfate (sodium laureth sulfate). When the cleaning compositions include an anionic surfactant component, the composition typically includes about 0.1 to 5 wt. % and, more commonly, about 0.5 to 3 wt. % anionic surfactant.

When the present cleaning composition includes an anionic surfactant component, quite commonly the composition includes an alkyl sulfate salt and/or alkyl sulfonate salt. For example, the cleaning composition may include a sodium $C_{8-12}$-alkyl sulfate, such as sodium lauryl and/or sulfate sodium octyl sulfate. In other embodiments, the cleaning composition may include an ethoxylated fatty alcohol sulfate and/or sulfonate ester, such as sodium laureth sulfate, as an anionic surfactant.

As discussed above, the present cleaning compositions may optionally include an antimicrobial quaternary ammonium surfactant, such as a quaternary benzyl ammonium salt and/or a quaternary dialkyl ammonium salt. For example, the present cleaning compositions may include an N-(n-$C_{12-16}$)-alkyl-N-benzyl dimethylammonium chloride, an N-(n-$C_{12-16}$)-alkyl-N-ethylbenzyl dimethylammonium chloride and/or a bis(n-$C_{8-12}$-alkyl)dimethylammonium chloride. When the cleaning compositions include an antimicrobial quaternary ammonium surfactant, it is typically present at about 0.05 to 1 wt. % and, more commonly, about 0.1 to 0.4 wt. % of the composition.

In some embodiments, the antimicrobial quaternary ammonium surfactant may include a quaternary benzyl ammonium surfactant. The quaternary benzyl ammonium surfactant may include an N-alkyl-N,N-dimethyl (optionally substituted)benzyl ammonium salt. In some embodiments, the antimicrobial quaternary ammonium surfactant may include N—$C_{10-18}$-alkyl-N,N-dimethyl benzyl ammonium halide and/or N—$C_{10-18}$-alkyl-N,N-dimethyl ethylbenzyl ammonium halide. In another embodiment, the antimicrobial quaternary ammonium surfactant may include N—$C_{12-14}$-alkyl-N,N-dimethyl benzyl ammonium chloride and/or N—$C_{12-14}$-alkyl-N,N-dimethyl ethylbenzyl ammonium chloride. In some embodiments, the antimicrobial quaternary ammonium surfactant may include N-n-$C_{12-14}$-alkyl-N,N-dimethyl benzyl ammonium chloride and/or N-n-$C_{12-14}$-alkyl-N,N-dimethyl ethylbenzyl ammonium chloride.

In some embodiments, the antimicrobial quaternary ammonium surfactant may include a quaternary dialkyl ammonium surfactant. Examples of suitable quaternary dialkyl ammonium surfactants include N,N-di-$C_{8-18}$-alkyl-N,N-dimethyl ammonium halides, such as bis(n-$C_{8-12}$-alkyl) dimethylammonium chlorides. In some embodiments, the antimicrobial quaternary ammonium surfactant may include N,N-dioctyl-N,N-dimethyl ammonium chloride, N,N-didecyl-N,N-dimethyl ammonium chloride and N-octyl-N-decyl-N,N-dimethyl ammonium chloride.

Examples of the antimicrobial quaternary ammonium surfactants include, but are not limited to, BTC® 885 (available from Stepan Company), BTC® 888 (available from Stepan Company), BTC® 2125M (available from Stepan Company), Bardac 2280 (available from Lonza), Barquat MB-80 (available from Lonza), Bardac 2250 (available from Lonza), and Carboquat H (available from Lonza). BTC® 885 is a quaternary ammonium antimicrobial surfactant which is a mixture of n-alkyl (50% C14, 40% C12, 10% C16) dimethyl benzyl ammonium chloride (20%), n-octyl, n-decyl dimethyl ammonium chloride (15), di-n-octyl dimethyl ammonium chloride (7.5%), and di-n-decyl dimethyl ammonium chloride (7.5%). BTC® 888 is a mixture of n-alkyl (50% C14, 40% C12, 10% C16) dimethyl benzyl ammonium chloride (32%), n-octyl, n-decyl dimethyl ammonium chloride (24%), di-n-octyl dimethyl ammonium chloride (12%), and di-n-decyl dimethyl ammonium chloride (12%). BTC® 2125M is a mixture of n-alkyl (60% C14, 30% C16, 5% C12, 5% C18) dimethyl benzyl ammonium chloride and n-alkyl (68% C12, 32% C14) dimethyl ethylbenzyl ammonium chloride. Bardac 2280 is N,N-Didecyl-N,N-dimethylammoniumchloride. Barquat MB-80 is a mixture of n-alkyl (50% C14, 40% C12, 10% C16) dimethyl benzyl ammonium chloride salts. Bardac 2250 is di-n-decyl dimethyl ammonium chloride. Carboquat H is a mixture di-n-decyl dimethyl ammonium carbonate and bicarbonate salts.

In some aspects, the cleaning composition may also include a chelating agent. Suitable chelating agents include aminopolycarboxylate chelating agents, such as an iminodisuccinate salt and/or an ethylenediaminetetraacetate salt. Other suitable aminopolycarboxylate chelating agents include salts of hydroxyethylethylenediaminetriacetate (HEEDTA), 2-hydroxyethyliminodiacetate (HEIDA), and/or nitrilotriacetate (NTA). Other suitable aminopolycarboxylate chelating agents include glutamate diacetic acid salts, diethylenetriaminepentaacetic acid salts (DETAPA), triethylenetetraminehexaacetic acid salts (TETAHA), 1,3-diamino-2-hydroxypropane-N,N,N',N'-tetraacetic acid salts, and/or 1,2-diaminocyclohexane-N,N,N',N'-tetraacetic acid salts. In some instances, the cleaning composition may also include an alkali metal of the aminopolycarboxylate chelating agent, typically a sodium or potassium salt of the chelating agent. For example, the cleaning composition may also include an alkali metal of iminodisuccinic acid, e.g., tetrasodium iminodisuccinate, and/or an alkali metal sodium salt glutamate diacetic acid, e.g., the tetrasodium salt glutamate diacetic acid. Commonly, where an aminopolycarboxylate chelating agent is present in the cleaning composition, the composition includes a sodium salt of iminodisuccinic acid and/or a sodium salt of glutamate diacetic acid.

The present cleaning compositions may also include additional components or agents, such as additional functional materials (which may also be referred to as "adjuvants"). In some embodiments, the functional materials may be included to provide desired properties and functionalities to the cleaning composition. For the purpose of this application, the term "functional materials" include a material that when dispersed or dissolved in a concentrate and/or use solution, such as an aqueous solution, provides a beneficial property in a particular use. The present cleaning preparations containing the ionic liquids may optionally contain other soil-digesting components, surfactants, disinfectants, detergent fillers, sanitizers, acidulants, complexing agents, biocides, corrosion inhibitors, anti-redeposition agents, foam inhibitors, dyes, bleaching agents, enzymes, enzyme stabilizing systems, thickening or gelling agents, wetting agents, dispersants, stabilizing agents, and/or fragrances.

For example, the aqueous cleaning compositions may also include various adjuvants as is conventional for hard surface cleaners. Examples of such adjuvants include one or more of a fragrance, preservative, dyes, corrosion inhibitors, antioxidants and the like. Adjuvants are generally present in an amount less than about 0.5 wt. % and commonly are present in an amount of about 100 ppm to about 0.2 wt. % of the composition. Quite commonly, the present the aqueous cleaning compositions may include a fragrance material and a preservative.

In another aspect, the present technology provides a method for cleaning a hard surface that includes applying any of the cleaning composition disclosed herein to a hard surface. The method further comprising removing the composition from the hard surface. Typically, the removal of the composition from the hard surface is conducted by scrubbing by hand. In some embodiments, the removal of the composition from the hard surface is conducted by rinsing with water that is not highly pressurized (e.g., sink or shower facet water). In some instances, where the hard surface includes a first concentration of soap scum, after removal of the composition from the hard surface, the hard surface includes a second concentration of soap scum which is no more than about 50% of the first concentration of soap scum. In some embodiments, the second concentration of soap scum may be at least about 60%, at least about 70%, or at least about 80% less than the first concentration of soap scum.

As used herein, "fragrance" refers to any perfume, odor-eliminator, odor masking agent, the like, and combinations thereof. In some embodiments, a fragrance is any substance which may have an effect on a consumer, or user's, olfactory senses.

As used herein, "wt. %" refers to the weight percentage of an ingredient in the total formula. For example, an off-the-shelf commercial composition of Formula X may only contain 70% active ingredient X. Thus, 10 g of the off-the-shelf composition only contains 7 g of X. If 10 g of the off-the-shelf composition is added to 90 g of other ingredients, the wt. % of X in the final formula is thus only 7%.

EXAMPLES

The following examples more specifically illustrate protocols for preparing aqueous cleaning compositions according to various embodiments described above. These examples should in no way be construed as limiting the scope of the present technology.

Example 1

Table 1 below shows the composition of a number of exemplary formulations of the present aqueous cleaning compositions. These formulations include a 3:1 mole ratio of N-decyl-N,N-dimethyl amine to citric acid as the ionic liquid component ("3:1 C10DMA:Citrate"). The amine salt may be added as a powdered solid or formed by adding the N-decyl-N,N-dimethyl amine and citric acid to water. The results of the Soap Scum Test ("SS") shown in Table 1 demonstrate the relative effectiveness of these formulations. Several formulations (C1-C3), which do not include any of the ionic liquid, are shown for comparison purposes. These formulations only include the listed components and a balance of water. In addition to the results of the Soap Scum Test, the relative effectiveness of these formulations in the removal of greasy kitchen soil ("GKS"—% removal) is shown in Table 1.

TABLE 1

| Experiment | C10DMA:Citrate | 7EO-LA | Lauryl Amine Oxide | Sodium Octyl Sulfate | GKS | SS |
|---|---|---|---|---|---|---|
| 1 | 1.48 | 0 | 1.1 | 0 | 15.9 | 94.53 |
| 2 | 1.48 | 1 | 0 | 3.6 | 87.6 | 53.1 |
| 3 | 1.48 | 2 | 2.2 | 1.8 | 92.4 | 80.76 |
| 4 | 2.96 | 0 | 0 | 1.8 | 95.3 | 98.99 |
| 5 | 2.96 | 1 | 2.2 | 0 | 16.1 | 99.49 |

TABLE 1-continued

| Experiment | C10DMA:Citrate | 7EO-LA | Lauryl Amine Oxide | Sodium Octyl Sulfate | GKS | SS |
|---|---|---|---|---|---|---|
| 6 | 2.96 | 2 | 1.1 | 3.6 | 93.5 | 97.46 |
| C1 | 0 | 0 | 2.2 | 3.6 | 15.3 | 10.85 |
| C2 | 0 | 1 | 1.1 | 1.8 | 40.9 | 47.82 |
| C3 | 0 | 2 | 0 | 0 | 15.3 | 60.23 |

7EO-LA—Ethoxylated (7EO) lauryl alcohol

Example 2

Table 2 below shows the composition of two exemplary formulations of the present aqueous cleaning compositions. These formulations include an N-decyl-N,N-dimethyl amine citrate salt as the ionic liquid component ("C10DMA:Citrate"). The amine salt was formed by adding the N-decyl-N,N-dimethyl amine and citric acid to water. These formulations also include a nonionic surfactant (an ethoxylated (7EO) C12 alcohol), an anionic surfactant (sodium octyl sulfate) and, optionally, a quaternary ammonium antimicrobial surfactant (Barquat MB-80). Barquat MB-80 is a mixture of n-alkyl (50% C14, 40% C12, 10% C16) dimethyl benzyl ammonium chloride salts. As demonstrated by the test results shown in Table 3, the two formulations are effective to remove both greasy kitchen soil ("GKS") and soap scum from hard surfaces (results shown for both tests are % removal).

TABLE 2

| Raw Material | Formulation 2-1 wt. % | Formulation 2-2 wt. % |
|---|---|---|
| Water | 94.57 | 94.13 |
| C10DMA | 1.48 | 1.48 |
| Citric acid | 0.85 | 0.85 |
| Ethoxylated (7EO) C12 alcohol | 2 | 2 |
| Antimicrobial Quat (MB80) | 0 | 0.3 |
| IDSA | 0 | 0.14 |
| Na Octyl sulfate | 1 | 1 |
| Fragrance | 0.1 | 0.1 |
| pH | 4.4 | 4.47 |
| GKS | 74 | 65 |
| Soap Scum (ASTM D5343) | 84 | 84 |

Soap Scum Test.

The following test was used to evaluate the cleaning capability of various cleaning compositions to remove soap scum from a hard surface (Soap Scum Test—"SS"). The following is a brief description of the "soap scum" removal test.

Soil and Test Plate Preparation:

1. SOAP SCUM SOIL IS PREPARED USING PRECIPITATED FATTY ACID SALTS.
2. TEST PLATES (TILE) ARE PRECLEANED, DRIED, AND WEIGHED PRIOR TO SOILING. THE PRESOILING WEIGHT OF EACH PLATE IS RECORDED.
3. THE SOAP SCUM SOIL IS APPLIED TO TEST PLATES IN A MANNER TO ENSURE CONSISTENCY REGARDING THE AMOUNT AND AREA OF SOIL APPLIED.
4. SOILED PLATES ARE THEN BAKED TO CURE THE SOIL. PLATES ARE COOLED TO ROOM TEMPERATURE PRIOR TO CLEANING TESTS.

Cleaning:

1. A SOILED PLATE IS SPRAYED (TRIGGER OR AEROSOL DISPENSER) WITH AN AMOUNT OF A TEST CLEANING FORMULA AND THEN THE PLATE IS PLACED ON A GARDNER SCRUBBING DEVICE.
2. A SPONGE OR OTHER CLEANING IMPLEMENT IS DAMPENED WITH WATER AND INSERTED INTO THE SCRUBBER'S SLED.
3. THE SLED IS POSITIONED ON THE TEST PLATE AND THE SCRUBBING DEVICE IS ACTIVATED.
4. AFTER A PREDETERMINED NUMBER OF CYCLES HAVE BEEN COMPLETED, THE SCRUBBING DEVICE IS STOPPED AND THE PLATE IS REMOVED.
5. THE CLEANED PLATE IS RINSED UNDER RUNNING WATER AND SET ASIDE TO AIR DRY.
6. THE CLEANING PROCEDURE IS REPEATED AS NEEDED FOR ADDITIONAL PLATES.

Assessment:

1. PLATES ARE WEIGHED AND STATISTICALLY ASSESSED TO DETERMINE THE AVERAGE PERCENT OF SOIL REMOVED ALONG WITH THE STANDARD DEVIATION (SD).
2. FORMULA TO FORMULA COMPARISONS CAN THEN BE MADE.

ILLUSTRATIVE EMBODIMENTS

Reference is made in the following to a number of illustrative embodiments of the subject matter described herein. The following embodiments describe illustrative embodiments that may include various features, characteristics, and advantages of the subject matter as presently described. Accordingly, the following embodiments should not be considered as being comprehensive of all of the possible embodiments or otherwise limit the scope of the methods, materials and compositions described herein.

In one aspect, the aqueous cleaning composition may include (a) N,N-dialkyl-N-aliphatic ammonium hydroxycarboxylate salt; (b) nonionic surfactant and/or anionic surfactant; and (c) at least about 85 wt. % water; where other than an optional fragrance component the composition is substantially free {e.g., ≤0.1 wt. %} of volatile organic compounds and, in particular, is substantially free {e.g., ≤0.1 wt. %} of glycol ether solvents, aliphatic alcohol solvents, polyol solvents and amino alcohol solvents. Such aqueous cleaning compositions commonly have a pH of about 4 to 7 and, often about 4 to 6. In such compositions the nonionic surfactant may include ethoxylated alkanol and/or alkyldimethylamine oxide. For example, the nonionic surfactant may include an ethoxylated $C_{10-15}$-alkanol having an average degree of ethoxylation of about 5 to 10. In some embodiments, the nonionic surfactant may include an N—$C_{10-14}$-fatty alkyldimethylamine oxide. When such aqueous cleaning compositions include an anionic surfactant, the composition may include an alkyl sulfonate salt and/or alkyl sulfate salt, such as a sodium $C_{8-12}$-alkyl sulfate. In some embodiments, the aqueous cleaning compositions may optionally include one or more of an antimicrobial quaternary ammonium surfactant, a fragrance material and a polycarboxylate chelating agent, such as an aminopolycarboxylate chelating agent.

The aqueous cleaning composition described in the paragraph above may also include a polycarboxylate chelating agent, such as an aminopolycarboxylate chelating agent. Suitable examples of aminopolycarboxylate chelating agents include an iminodisuccinate salt (IDSA), an ethylenediaminetetraacetate (EDTA) salt, a hydroxyethylethylenediaminetriacetate (HEEDTA) salt, 2-hydroxyethyliminodiacetate (HEIDA) salt, a nitrilotriacetate (NTA) salt, a glutamate diacetic acid (GDAA) salt, a diethylenetriaminepentaacetic acid (DETAPA) salt, a triethylenetetraminehexaacetic acid (TETAHA) salt, a 1,3-diamino-2-hydroxypropane-N,N,N',N'-tetraacetic acid salt and/or a 1,2-diaminocyclohexane-N,N,N',N'-tetraacetic acid salt. Quite commonly, the aminopolycarboxylate chelating agent includes a sodium iminodisuccinate salt and/or a sodium glutamate diacetic acid salt.

In many instances, the aqueous cleaning composition described above may also include a quaternary ammonium antimicrobial surfactant, such as a quaternary benzyl ammonium salt and/or a quaternary bis(alkyl)dimethylammonium salt. Suitable quaternary benzyl ammonium salts include N-(n-$C_{12-16}$)-alkyl-N-benzyl dimethylammonium chloride and N-(n-$C_{12-16}$)-alkyl-N-ethylbenzyl dimethylammonium chloride. Suitable quaternary bis(alkyl)dimethylammonium salts include bis(n-$C_{8-12}$-alkyl)dimethylammonium chloride.

In the aqueous cleaning compositions described in the paragraphs immediately above, the N,N-dialkyl-N-aliphatic ammonium hydroxycarboxylate salt may include an N,N-di-($C_{1-3}$) alkyl-N-fatty ammonium hydroxycarboxylate salt or other N,N-di-($C_{1-3}$)alkyl-N—($C_{8-18}$)—N-aliphatic ammonium hydroxycarboxylate salt. The N,N-dialkyl-N-aliphatic ammonium hydroxycarboxylate salt includes a salt of citric acid, tartaric acid, lactic acid, glucaric acid, gluconic acid and/or malic acid. The N,N-dialkyl-N-fatty ammonium hydroxycarboxylate salt suitably includes an N,N-di-($C_{1-2}$)alkyl-N—($C_{8-14}$)-fatty ammonium hydroxycarboxylate salt, such as N,N-dimethyl-N-octylammonium citrate, N,N-dimethyl-N-decylammonium citrate, N,N-dimethyl-N-dodecylammonium citrate and/or N,N-dimethyl-N-tetradecylammonium. In some embodiments, the N,N-dialkyl-N-fatty ammonium hydroxycarboxylate salt may suitably include an N,N-di-($C_1$-$C_3$)alkyl-N—($C_8$-$C_{14}$)-n-alkylammonium hydroxycarboxylate, such as N,N-dimethyl-N-n-octyl ammonium citrate, N,N-dimethyl-N-n-decyl ammonium citrate, N,N-dimethyl-N-lauryl ammonium citrate and/or N,N-dimethyl-N-myristyl ammonium citrate. In some embodiments, the N,N-dialkyl-N-fatty ammonium hydroxycarboxylate salt may suitably include N,N-dimethyl-N-n-octyl ammonium lactate, N,N-dimethyl-N-n-decyl ammonium lactate, N,N-dimethyl-N-lauryl ammonium lactate and/or N,N-dimethyl-N-myristyl ammonium lactate.

When the aqueous cleaning compositions described in the paragraphs immediately above include an ethoxylated alcohol non-ionic surfactant, it may suitably include ethoxylated $C_{8-16}$-aliphatic alcohol having an average degree of ethoxylation of about 5 to 12. For example, the cleaning compositions may include an ethoxylated $C_{8-16}$-Guerbet alcohol, another secondary ethoxylated $C_{8-16}$-aliphatic alcohol and/or an ethoxylated $C_{8-16}$-n-alkanol. Very often, such compositions include an ethoxylated $C_{10-15}$-alkanol having an average degree of ethoxylation of about 5 to 10.

In another aspect, the aqueous cleaning composition may include (a) N,N-dialkyl-N-aliphatic ammonium hydroxycarboxylate salt; (b) nonionic surfactant and/or anionic surfactant; and (c) at least about 85 wt. % water; wherein the composition has a pH of about 4 to 7. Such compositions are commonly substantially free {e.g., contain ≤0.1 wt. %} of glycol ether solvents, aliphatic alcohol solvents, polyol solvents and amino alcohol solvents. Very often, other than including an optional fragrance material such compositions are substantially free {e.g., ≤0.1 wt. %} of volatile organic compounds.

In another aspect, the aqueous cleaning composition may include (a) about 0.05 to 4 wt. % N,N-dimethyl-N—$C_{8-12}$-alkylammonium citrate; (b) about 0.5 to 3 wt. % sodium $C_{8-12}$-alkyl sulfate; (c) about 0.5 to 3 wt. % ethoxylated $C_{10-15}$-alkanol; and (d) at least about 90 wt. % water. Such compositions commonly have a pH of about 4 to 7 and, other than an optional fragrance component, contain no more than 0.1 wt. % volatile organic compounds.

In another aspect, the aqueous cleaning composition may include (a) N,N-dimethyl-N—$C_{8-12}$-alkylammonium citrate; (b) sodium $C_{8-12}$-alkyl sulfate; (c) ethoxylated $C_{10-15}$-alkanol; and (d) at least about 85 wt. % water. Such compositions commonly have a pH of about 4 to 7 and other than an optional fragrance component, contain no more than 0.1 wt. % volatile organic compounds.

In another aspect, the aqueous cleaning composition may include (a) N,N-dialkyl-N—$C_{8-14}$-fatty alkylammonium hydroxycarboxylate salt; (b) ethoxylated alkanol, alkyldimethylamine oxide, alkyl sulfate salt and/or alkyl sulfonate salt; and (c) at least about 85 wt. % water. Other than an optional fragrance component, such compositions are substantially free of glycol ether solvents, aliphatic alcohol solvents, polyol solvents and amino alcohol solvents. These cleaning composition may also include one or more of antimicrobial quaternary ammonium surfactant, fragrance material, aminopolycarboxylate chelating agent and preservative. Desirably, the cleaning composition may have a pH of about 4 to 6. Other than an optional fragrance component, the composition may contains no more than 0.1 wt. % volatile organic compounds. In such cleaning compositions, the N,N-dialkyl-N—$C_{8-14}$-fatty alkylammonium hydroxycarboxylate salt may include N-octyl dimonium citrate, N-decyl dimonium citrate, N-lauryl dimonium citrate, and/or N-myristyl dimonium citrate. In some embodiments, the N,N-dialkyl-N—$C_{8-14}$-fatty alkylammonium hydroxycarboxylate salt may include N-caprylyl dimonium lactate, N-capryl dimonium lactate, N-lauryl dimonium citrate and/or N-myristyl dimonium citrate.

In another aspect, the aqueous cleaning composition may include (a) about 1 to 4 wt. % N,N-dimethyl-N—$C_{8-12}$-n-alkylammonium citrate; (b) about 0.5 to 3 wt. % sodium $C_{8-12}$-alkyl sulfate; (c) about 0.5 to 3 wt. % ethoxylated $C_{10-15}$-alkanol; and (d) at least about 90 wt. % water. Such aqueous cleaning compositions may have a pH of about 4 to 7 and, other than an optional fragrance component, the composition contains no more than 0.1 wt. % volatile organic compounds. Such cleaning compositions may also include about 0.1 to 0.3 wt. % fragrance material.

In another aspect, the aqueous cleaning composition may include (a) about 0.05 to 5 wt. % N,N-dimethyl-N-n-decylammonium citrate; (b) about 0.5 to 5 wt. % sodium octyl sulfate; (c) about 0.5 to 5 wt. % ethoxylated $C_{10-15}$-alkanol having an average degree of ethoxylation of about 5 to 10; and (d) at least about 90 wt. % water. Such compositions typically have a pH of about 4 to 6 and, other than an optional fragrance component, contain no more than 0.1 wt.

% volatile organic compounds. In some embodiments cleaning composition may also include about 0.1 to 0.5 wt. % of an aminopolycarboxylate chelating agent, such as an iminodisuccinate salt. In some embodiments, such aqueous cleaning composition may also include about 0.1 to 0.4 wt. % antimicrobial quaternary ammonium surfactant. In some embodiments, such aqueous cleaning composition may also include about 0.05 to 0.3 wt. % of a fragrance material.

In another aspect, the aqueous cleaning composition may include (a) about 1 to 4 wt. % N,N-dimethyl-N-n-decylammonium citrate; (b) about 1 to 4 wt. % sodium octyl sulfate; and (c) at least about 90 wt. % water, where the composition has a pH of about 4 to 6. Other than an optional fragrance component, such compositions commonly contain no more than 0.1 wt. % volatile organic compounds. In some embodiments, such aqueous cleaning composition may also include an nonionic surfactant, such an ethoxylated alkanol and/or alkyldimethylamine oxide. In some embodiments, such aqueous cleaning composition may also include a polycarboxylate chelating agent, such as an aminopolycarboxylate chelating agent. In some embodiments, such aqueous cleaning composition may also include an antimicrobial quaternary ammonium surfactant.

In many instances, the aqueous cleaning composition described herein may include the following weight percent of the various components.

| Raw Material | Wt % |
|---|---|
| Water | 75-98 |
| Ionic liquid | 0.1-5 |
| Nonionic and/or anionic surfactant | 0.1-5 |
| Quat. ammonium antimicrobial surfactant | 0-0.5 |
| Hydroxycarboxylic acid chelating agent | 0-2 |
| Aminopolycarboxylate chelating agent | 0-5 |
| Preservative | 0-0.1 |
| Fragrance | 0-0.3 |
| pH | 4-6 |

While certain embodiments have been illustrated and described, it should be understood that changes and modifications can be made therein in accordance with ordinary skill in the art without departing from the technology in its broader aspects.

The embodiments, illustratively described herein may suitably be practiced in the absence of any element or elements, limitation or limitations, not specifically disclosed herein. Thus, for example, the terms "comprising," "including," "containing," shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term.

The use of the terms "a" and "an" and "the" and similar referents in the context of describing the elements (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the embodiments and does not pose a limitation on the scope of the claims unless otherwise stated. No language in the specification should be construed as indicating any non-claimed element as essential.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof.

What is claimed is:

1. An aqueous cleaning composition comprising:

(a) N,N-dialkyl-N-aliphatic ammonium hydroxy carboxylate salt;

(b) nonionic surfactant and anionic surfactant; and (c) at least about 85 wt. % water;

wherein other than an optional fragrance component the composition contains no more than 0.1 wt. % volatile organic compounds.

2. The composition of claim 1, wherein the composition has a pH of about 4 to 7.

3. The composition of claim 1, wherein the nonionic surfactant comprises ethoxylated alkanol and/or alkyldimethylamine oxide.

4. The composition of claim 1, wherein the anionic surfactant comprises alkyl sulfate salt and/or alkyl sulfonate salt.

5. The composition of claim 1, further comprising antimicrobial quaternary ammonium surfactant.

6. The aqueous cleaning composition of claim 1 comprising:

(a) about 0.05 to 5 wt. % N,N-dimethyl-N-n-decylammonium citrate;

(b) about 0.5 to 5 wt. % sodium octyl sulfate;

(c) about 0.5 to 5 wt. % ethoxylated $C_{10-15}$-alkanol having an average degree of ethoxylation of about 5 to 10; and (d) at least about 90 wt. % water;

wherein the composition has a pH of about 4 to 6.

7. The composition of claim 6, further comprising about 0.1 to 0.5 wt. % iminodisuccinate salt.

8. The composition of claim 1, further comprising an aminopolycarboxylate chelating agent selected from the group consisting of an iminodisuccinate salt (IDSA), an ethylenediaminetetraacetate (EDTA) salt, a hydroxyethylethylenediaminetriacetate (HEEDTA) salt, 2-hydroxyethyliminodiacetate (HEIDA) salt, a nitrilotriacetate (NTA) salt, a glutamate diacetic acid (GDAA) salt, a diethylenetriaminepentaacetic acid (DETAPA) salt, a triethylenetetraminehexaacetic acid (TETAHA) salt, a 1,3-diamino-2-hydroxypropane-N,N,N',N'-tetraacetic acid salt and/or a 1,2-diaminocyclohexane-N,N,N',N'-tetraacetic acid salt.

9. The composition of claim 1, further comprising an aminopolycarboxylate chelating agent, which comprises a sodium iminodisuccinate salt and/or a sodium glutamate diacetic acid salt.

10. The composition of claim 1, wherein the N,N-dialkyl-N-aliphatic ammonium hydroxy carboxylate salt comprises N,N-di-($C_{1-3}$)alkyl-N—($C_{8-18}$)—N-aliphatic ammonium hydroxy carboxylate salt.

11. The aqueous cleaning composition of claim 1 comprising:

(a) about 0.05 to 3 wt. % N,N-dimethyl-N—$C_{8-12}$-alkylammonium citrate;

(b) about 0.5 to 3 wt. % sodium $C_{6-10}$-alkyl sulfate;

(c) about 0.5 to 3 wt. % ethoxylated $C_{10-15}$-alkanol; and (d) at least about 90 wt. % water;

wherein the composition has a pH of about 4 to 7 and, other than an optional fragrance component, the composition contains no more than 0.1 wt. % volatile organic compounds.

12. An aqueous cleaning composition comprising:

(a) N,N-dialkyl-N—$C_{8-14}$-fatty alkylammonium hydroxy carboxylate salt;

(b) ethoxylated alkanol and/or alkyldimethylamine oxide;

(c) alkyl sulfate salt and/or alkyl sulfonate salt; and (d) at least about 85 wt. % water;

wherein, other than an optional fragrance component, the composition is substantially free of glycol ether solvents, aliphatic alcohol solvents, polyol solvents and amino alcohol solvents.

13. The composition of claim 12, further comprising one or more of antimicrobial quaternary ammonium surfactant, fragrance material, aminopolycarboxylate chelating agent and preservative.

14. The composition of claim 12, wherein the N,N-dialkyl-N—$C_{8-14}$-fatty alkylammonium hydroxy carboxylate salt is selected from the group consisting of N-octyl dimonium citrate, N-decyl dimonium citrate, N-lauryl dimonium citrate, N-myristyl dimonium citrate, N,N-dimethyl-N-n-octyl ammonium lactate, N,N-dimethyl-N-n-decyl ammonium lactate, N,N-dimethyl-N-lauryl ammonium lactate and/or N,N-dimethyl-N-myristyl ammonium lactate.

15. An aqueous cleaning composition comprising:

(a) about 1 to 4 wt. % N,N-dimethyl-N-n-decylammonium citrate;

(b) about 1 to 4 wt. % $C_{8-12}$-alkyl sulfate salt; and (c) at least about 90 wt. % water;

wherein the composition has a pH of about 4 to 6 and, other than an optional fragrance component, the composition contains no more than 0.1 wt. % volatile organic compounds.

16. The composition of claim 15, further comprising an ethoxylated $C_{10-15}$-alkanol.

17. The composition of claim 15, further comprising a sodium iminodisuccinate salt and/or a sodium glutamate diacetic acid salt.

18. The composition of claim 15, further comprising an antimicrobial quaternary ammonium surfactant, which comprises a quaternary benzyl ammonium salt and/or a quaternary bis(alkyl)dimethylammonium salt.

19. The composition of claim 15, further comprising about 1 to 3 wt. % of an ethoxylated $C_{10-15}$-alkanol having an average degree of ethoxylation of about 5 to 10;

about 0.1 to 5 wt. % of an aminopolycarboxylate chelating agent, which comprises a sodium iminodisuccinate salt and/or a sodium glutamate diacetic acid salt; and about 0.1 to 0.4 wt. % of an antimicrobial quaternary ammonium surfactant.

20. The composition of claim 15, further comprising polycarboxylate chelating agent.

21. The composition of claim 1, wherein the N,N-dialkyl-N-aliphatic ammonium hydroxy carboxylate salt comprises N,N-dimethyl-N—($C_{8-14}$)-n-alkyl ammonium citrate;

the nonionic and/or anionic surfactant comprises ethoxylated $C_{10-15}$-alkanol nonionic surfactant and $C_{6-10}$-alkyl sulfate anionic surfactant; and the composition further comprises polycarboxylate chelating agent.

* * * * *